US009286871B2

(12) United States Patent
Johnson

(10) Patent No.: US 9,286,871 B2
(45) Date of Patent: Mar. 15, 2016

(54) SYSTEM FOR CALCULATING THE TEMPO OF MUSIC

(71) Applicant: ClevX, LLC, Kirkland, WA (US)

(72) Inventor: Simon B. Johnson, Bonney Lake, WA (US)

(73) Assignee: ClevX, LLC, Kirkland, WA (US)

( * ) Notice: Subject to any disclaimer, the term of this patent is extended or adjusted under 35 U.S.C. 154(b) by 0 days.

(21) Appl. No.: 14/612,132

(22) Filed: Feb. 2, 2015

(65) Prior Publication Data

US 2015/0143977 A1 May 28, 2015

Related U.S. Application Data

(63) Continuation of application No. 13/945,977, filed on Jul. 19, 2013, now Pat. No. 8,952,233.

(60) Provisional application No. 61/683,937, filed on Aug. 16, 2012.

(51) Int. Cl.

| | |
|---|---|
| ***G10H 7/00*** | (2006.01) |
| ***G10H 1/40*** | (2006.01) |
| ***G10H 1/36*** | (2006.01) |

(52) U.S. Cl.

CPC ..... *G10H 1/40* (2013.01); *G10H 1/368* (2013.01); *G10H 2210/076* (2013.01); *G10H 2240/325* (2013.01)

(58) Field of Classification Search

CPC ..... G10H 2210/076; G10H 1/368; G10H 2240/325; G10H 1/40

USPC ..... 84/612, 652

See application file for complete search history.

(56) References Cited

U.S. PATENT DOCUMENTS

| | | | | |
|---|---|---|---|---|
| 4,376,404 | A * | 3/1983 | Haddad | 84/464 R |
| 5,614,687 | A * | 3/1997 | Yamada et al. | 84/662 |
| 6,175,632 | B1 * | 1/2001 | Marx | 381/56 |
| 6,812,394 | B2 * | 11/2004 | Weissflog | 84/667 |
| 7,012,183 | B2 * | 3/2006 | Herre et al. | 84/611 |
| 7,473,837 | B2 * | 1/2009 | Cui et al. | 84/464 R |
| 7,507,901 | B2 | 3/2009 | Kobayashi | |
| 7,923,621 | B2 | 4/2011 | Shiraishi et al. | |
| 7,999,168 | B2 * | 8/2011 | Nakadai et al. | 84/611 |
| 8,210,894 | B2 | 7/2012 | Chan | |
| 8,569,606 | B2 | 10/2013 | Khoo et al. | |
| 2005/0217463 | A1 * | 10/2005 | Kobayashi | 84/612 |
| 2007/0022867 | A1 * | 2/2007 | Yamashita | 84/612 |
| 2009/0114081 | A1 | 5/2009 | Kobayashi | |
| 2009/0308228 | A1 * | 12/2009 | Hurwitz et al. | 84/612 |
| 2012/0234160 | A1 * | 9/2012 | Khoo et al. | 84/660 |

* cited by examiner

*Primary Examiner* — Jeffrey Donels

(74) *Attorney, Agent, or Firm* — Ishimaru & Associates LLP

(57) ABSTRACT

A music tempo calculation system includes an amplitude adjuster for receiving an electrical signal of the music and outputting an amplitude-adjusted electrical signal; a detector for receiving said amplitude-adjusted electrical signal and outputting a beat signal when an amplitude of said amplitude-adjusted electrical signal exceeds a threshold value; and a computer for receiving said beat signal and calculating the tempo of the music.

18 Claims, 6 Drawing Sheets

20
MUSIC
22
MICROPHONE
ELECTRICAL SIGNAL, 24
AMPLITUDE ADJUSTER
26
AMPLIFIER
30
AMPLIFIED ELECTRICAL SIGNAL, 32
ATTENUATOR
34
AMPLITUDE-ADJUSTED ELECTRICAL SIGNAL, 28
DETECTOR
40
VU0-VU4
LED INDICATORS
44
BEAT SIGNAL, 42
COMPUTER
46
TEMPO
50
TEMPO DISPLAY
48
AMPLITUDE CONTROL SIGNAL, 36

SYSTEM FOR CALCULATING THE TEMPO OF MUSIC

CROSS REFERENCE TO RELATED APPLICATIONS

This is a continuation of U.S. patent application Ser. No. 13/945,977, filed Jul. 19, 2013, now U.S. Pat. No. 8,952,233, which claims the filing benefit under 35 U.S.C. §119(e) of U.S. Provisional Application No. 61/683,937, filed Aug. 16, 2012, which is hereby incorporated by reference.

TECHNICAL FIELD

The present invention pertains generally to music tempo, and more particularly to a system for calculating music tempo in beats per minute. In a second embodiment the system also synchronizes the motion of a motor to the tempo of the music.

BACKGROUND OF THE INVENTION

Live musical performances require drummers to set the song tempo by counting off the correct beats per minute (BPM). Metronomes are often used to initiate the correct tempo, but band and metronome quickly become out of sync as tempo begins to drift. It is not uncommon for songs to speed up or slow down during a performance—the most common problem is the song being played too fast. There are a number of products that detect BPM but require an operator tap on a key/button. This is inconvenient as it typically takes two hands to play a musical instrument. Some products sense BPM by detecting drum head strikes but these have had limited success.

Dancing (animated) toys have been around for many years. Many are driven by DC motors and have motion defined by the mechanics of their internal gear system. Synchronization of motion to sound must be provided by 'canned' music that is played from an internal speaker. Motion can be synchronized to sound, but it must be specified at design time since the animated toy is unable to adapt to audio input. Because of this limitation, animated toys are perceived as 'cute' at first, but customers quickly tire of the same repeated motion and songs.

Other current products claim to react to music beats by moving or flashing a light, but failure to do so is a common complaint from customers: blinking LEDs are hit and miss at best, and 'dance' is usually reduced to a repeated motion that has no correlation to tempo. Algorithms for beat detection developed over the years require complex mathematics and electronics. To date, most of this work has been performed by academics with few practical applications making it to the consumer market of animated toys.

Thus, there is a need for a low cost tempo-calculating system which provides feedback to musicians indicating music tempo, and which can also serve as a synchronization mechanism for synchronizing mechanical movements and with music tempo.

BRIEF SUMMARY OF THE INVENTION

Embodiments of the present invention provide a system for calculating a tempo of music, including: an amplitude adjuster for receiving an electrical signal of the music and outputting an amplitude-adjusted electrical signal; a detector for receiving said amplitude-adjusted electrical signal and outputting a beat signal when an amplitude of said amplitude-adjusted electrical signal exceeds a threshold value; and a computer for receiving said beat signal and calculating the tempo of the music.

Other embodiments, in addition to the embodiments enumerated above, will become apparent from the following detailed description, taken in conjunction with the accompanying drawings, which illustrate, by way of example, the principles of the system.

BRIEF DECRIPTION OF THE DRAWINGS

DETAILED DESCRIPTION OF THE INVENTION

Figure 1:
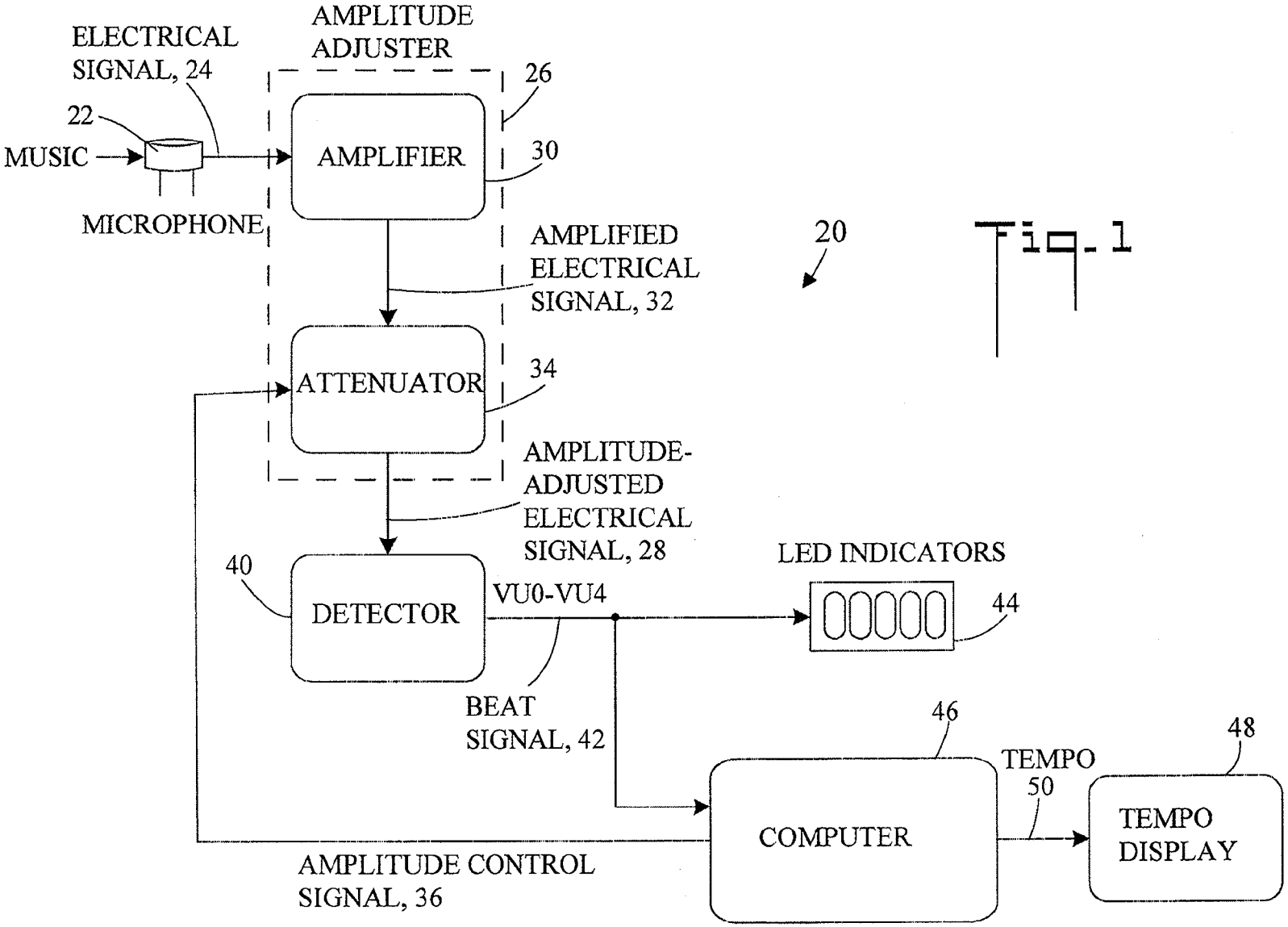
FIG. 1 is a block diagram of a system for calculating the tempo of music.

The present invention is directed to a system which uses off-the-shelf electronic components to calculate music tempo. Signal processing is performed in both hardware and software, in contrast to prior art devices which primarily place the processing burden on software. The system provides tempo feedback to musicians as BPM. In addition, tempo analysis leads to beat prediction. That is, knowing the time between beats and knowing when the last beat occurred, the occurrence of the next beat is predicted for controlling a motor which is used to animate toys. For example, dance is the synchronization of movement and beat. With any dance move, motion stops on the beat and resumes shortly thereafter. For example, when clapping one's hands, the hands are in motion until the moment of the next beat. It's the pause in motion that makes it appear movement is synchronized with music beat. Therefore, it is another aspect of the system to predict the occurrence of an upcoming beat and pause motion at that moment—resuming motion in the opposite direction shortly thereafter.

In an embodiment, the system uses a condenser microphone, signal amplifier, potentiometer, and a detector to process ambient music. A computer (microcontroller) is used to monitor output events from the detector. All of the components of the system are inexpensive and readily available. No conventional hardware A/D conversions or cross-correlation between peaks are required.

The system provides improvements to tempo detection which include:

- Accommodates variations in music volume whether from a radio or live rock band
- Accommodates variations in tempo which occur as a result of the music speeding up or slowing down
- Synchronizes mechanized motion by predicting the time of upcoming beats
- Reduction to practice in an inexpensive circuit suitable for integration with animated toys and consumer products.

In accordance with an embodiment, a system for calculating the tempo of music includes (1) a microphone which receives the music and converts the music into an electrical signal, (2) an amplitude adjuster which receives the electrical signal and outputs an amplitude adjusted electrical signal, (3)

a detector which receives the amplitude-adjusted electrical signal and outputs a beat signal when the amplitude of the amplitude-adjusted electrical signal exceeds a threshold value, and (4) a computer which receives the beat signal and calculates the tempo of the music.

In accordance with another embodiment, the system includes a tempo display which receives and displays the calculated tempo from the computer.

In accordance with another embodiment, the amplitude-adjuster includes an amplifier which receives the electrical signal and outputs an amplified electrical signal, and an attenuator which receives and selectively attenuates the amplified electrical signal, and outputs the amplitude-adjusted electrical signal.

In accordance with another embodiment, the attenuator is a digitally controlled potentiometer.

In accordance with another embodiment, the detector is a dot/bar display driver.

In accordance with another embodiment, the computer includes a counter which starts counting each time a beat signal is received, and stops counting when a next beat signal is received, the counter having a counter value when the counter stops counting. The computer also includes a memory which receives and stores a plurality of counter values.

In accordance with another embodiment, the computer includes a tempo calculator which uses the plurality of counter values to calculate the tempo of the music.

In accordance with another embodiment, the tempo calculator disregards counter values which would result in a tempo of less than about 60 beats per minute or greater than about 180 beats per minute in the calculation of tempo.

In accordance with another embodiment, the tempo calculator analyzes the plurality of counter values and selects a most probable counter value which is used to calculate the tempo.

In accordance with another embodiment, the tempo is calculated according to the following equation:

tempo in beats per minute=(60/most probable counter value)×$C$, where $C$ is the number of counts provided by the counter per second.

In accordance with another embodiment, the amplitude-adjuster includes an amplifier which receives the electrical signal and outputs an amplified electrical signal, and an attenuator which receives and selectively attenuates the amplified electrical signal and outputs the amplitude-adjusted electrical signal. The computer includes an amplitude control which sends an amplitude control signal to the attenuator.

In accordance with another embodiment, the amplitude control signal increases attenuation of the amplified electrical signal when a number of beat signals exceeds three in one second, and the amplitude control signal decreases attenuation of the amplified electrical signal when a number of beat signals is less than one in one second.

In accordance with another embodiment, the amplitude control signal changes attenuation of the amplified electrical signal in one of (1) single steps, and (2) multiple steps.

In accordance with another embodiment, the detector is a dot/bar display driver which provides a plurality of output signals ranging from a most sensitive output signal to a least sensitive output signal. If only the most sensitive output signal is present, the amplitude control signal changes attenuation of the amplified electrical signal in multiple steps.

In accordance with another embodiment, the system also includes (1) a motor which has clockwise direction of rotation and an opposite counterclockwise direction of rotation, (2) a motor driver which controls the motor, (3) a direction control signal which is sent from the computer to the motor driver, the direction control signal controlling the direction of rotation of the motor, the direction control signal having a clockwise state and a counterclockwise state, and (4) an enable signal which is sent from the computer to the motor driver, the enable signal turning the motor on or off.

In accordance with another embodiment, the computer includes a tempo calculator which outputs a beat interval, the computer also includes a motor timer which uses the beat interval to repeatedly count to an upcoming change in the direction of rotation of the motor.

In accordance with another embodiment, whenever a time between two successive beat signals is equal to the beat interval, the motor timer is reset.

In accordance with another embodiment, the system includes a beat event generator which generates a beat event signal whenever the interval between two successive beat signals equals the beat interval.

In accordance with another embodiment, the resetting of the motor timer ensures that the motor timer is synchronized with the music.

In accordance with another embodiment, the motor timer causes the enable signal to turn off before the beat interval ends, and to turn back on after the beat interval ends.

In accordance with another embodiment, the direction control signal changes state each time the enable signal is off.

Referring initially to FIG. 1, there is illustrated a block diagram of a system for calculating the tempo of music, the system generally designated as 20. System 20 includes a microphone 22 which receives (picks up) ambient music such as from a live band or from a stereo appliance, and converts the music into an electrical signal 24. In an embodiment, microphone 22 is a condenser microphone which is very small, low cost, and well suited for consumer products. An amplitude adjuster 26 (dashed box) receives electrical signal 24 and outputs an amplitude-adjusted electrical signal 28. In the shown embodiment, amplitude adjuster 26 includes an audio amplifier 30 which receives electrical signal 24 and outputs an amplified electrical signal 32. Amplifier 30 can be assembled from discrete components or purchased as a single module. Audio amplifier design is well known to those skilled in the art and will not be disclosed in detail.

Amplitude adjuster 26 also includes an attenuator 34 which receives and selectively attenuates amplified electrical signal 32, and outputs amplitude-adjusted electrical signal 28. Attenuator 34 provides amplitude (volume) control, and in one embodiment consists of a digital potentiometer such as a CA T5113. This is a digitally controlled potentiometer that has 100 possible values. If the maximum resistance is 10K ohms, CAT5113 can be set to provide values between 0 and 10K ohms in 100 ohm increments (steps). Thus, if amplitude-adjusted signal 28 is too high, attenuator 34 is adjusted to provide more resistance. Likewise, if amplitude-adjusted signal 28 is too low, attenuator 34 is adjusted to provide less resistance. This is similar to the volume control on any stereo appliance or TV. The adjustment of attenuator 34 is made automatically by an amplitude control signal 36 (see discussion below).

System 20 further includes a detector 40 which receives amplitude-adjusted electrical signal 28 and outputs a beat signal 42 (refer also to FIG. 2) when the amplitude of amplitude-adjusted electrical signal 28 exceeds a threshold value. In the shown embodiment detector 40 is a dot/bar display driver such as an LM3914 (a common and inexpensive off-the-shelf electronic IC), which is used in a volume unit (VU)

meter for displaying the signal level of audio equipment. A dot/bar display driver is an integrated circuit whose outputs change according to an analog input signal. The dot/bar display driver provides a plurality of output signals ranging from a most sensitive output signal to a least sensitive output signal. The most sensitive output signal is triggered by a low level music amplitude (volume), while the least sensitive music signal is only triggered by a high level music amplitude. In the shown embodiment, dot/bar display driver outputs five signals (VU0-VU4) wherein each output becomes active when the analog input reaches a predefined threshold. That is, a VU0 output signal is generated for low music amplitudes; if the music amplitude increases a VU1 output signal will be generated; if the amplitude increases further a VU2 output signal will be generated; if the amplitude increases further a VU3 output signal will be generated; and finally if the amplitude increases further a VU4 output signal will be generated. It is also noted that some dot/bar display drivers have a different number of outputs, such as seven or nine. In the shown embodiment, VU0 is the most sensitive output signal and VU4 is the least sensitive output signal. A common example is the VU meter present on many stereo appliances in which a series of indicators fluctuate with music. One also observes the number of illuminated indicators increase as volume is turned up. As the threshold of volume meets a predetermined value, each individual indicator turns on.

Detector 40 creates a digital output of amplitude-adjusted electrical signal 28 which is used to drive a series of LED indicators 44. LED indicators 44 are not a critical part of system 20, but are provided mainly to provide visual feedback regarding the adjustment of attenuator 34. Optimum performance occurs when all LEDs are fluctuating. When ambient music is loud, amplitude-adjusted electrical signal 28 can saturate detector 40 causing all LED indicators 44 to be illuminated all the time. Therefore, it becomes necessary to downwardly adjust the amplitude of amplitude-adjusted electrical signal 28 (by increasing the attenuation of attenuator 34) so that it will not saturate detector 40 (i.e until fluctuations in all LED indicators 44 are detected). Likewise, the opposite is true if ambient music is too quiet, and an upward adjustment of the amplitude of amplitude-adjusted electrical signal 28 is required (by decreasing the attenuation of attenuator 34). Amplitude control signal 36 from computer 46 (see discussion below) automatically adjusts the resistance of attenuator 34 up or down.

System 20 assumes a music beat is associated with a momentary increase in the output of detector 40. The onset of music beat is detected the moment all LED indicators 44 turn. One can visually correlate fluctuations in LED indicator 44 with beat onset. In other words, if one taps their toe along with music beat, it will become obvious that maximum output from LED indicators 44 will occur at the moment of a toe tap.

Figure 2:
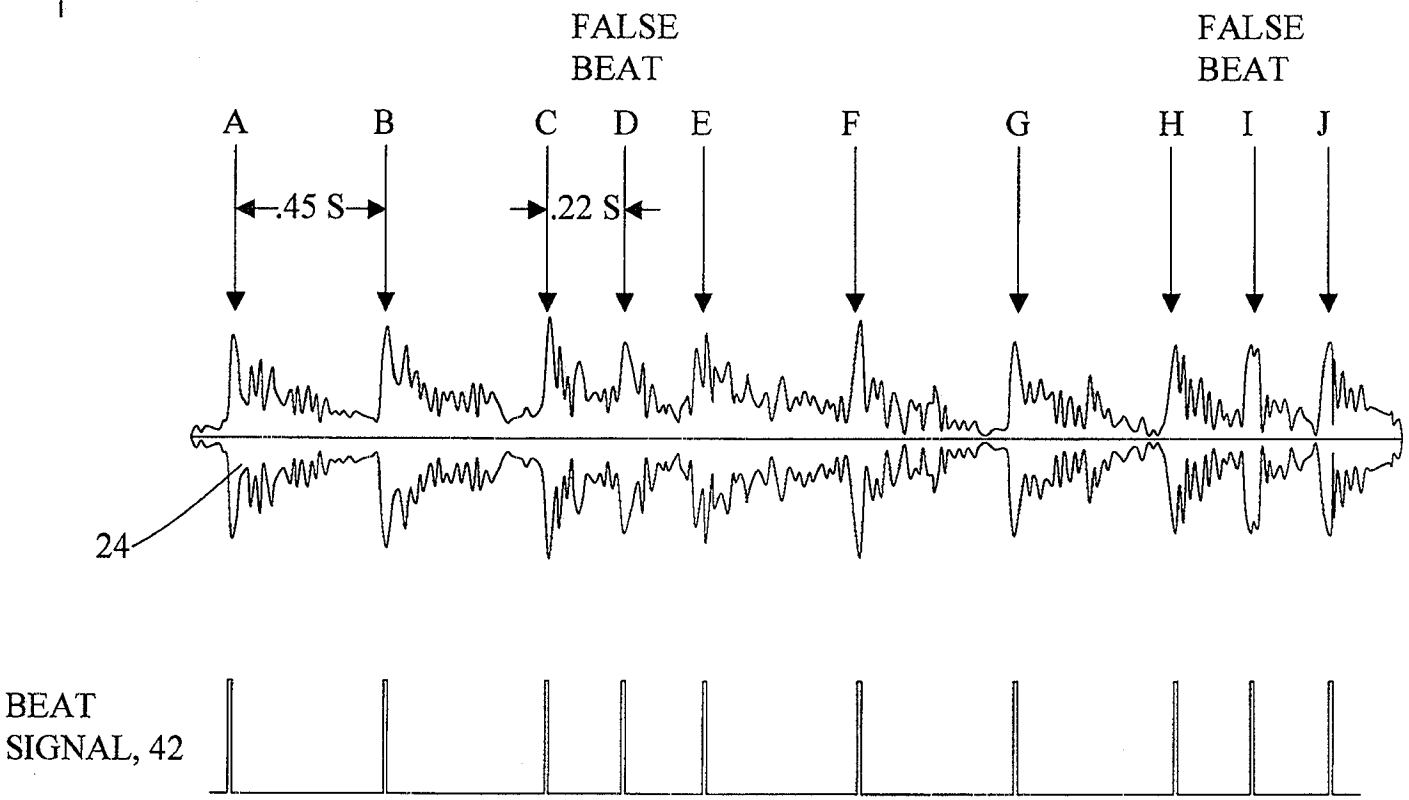
FIG. 2 is a music electrical signal showing beat signal occurrences.

It is appropriate at this point, to discuss the relationship of audio signals and beat. FIG. 2 is a music electrical signal 24 showing beat occurrences as a function of time. Typically, music is at its loudest on each beat as all instruments are playing together at that instant. Therefore, beat can be seen as peaks: A, B, C, D, E, F, G, H, I, and J. These are moments that the beat signal 42 output of detector 40 is maximum. Computer 46 must determine which peaks represent music beat and which are false positives (see discussion below).

In the example of FIG. 2, the time from a previous peak at B, C, F, G, and H is 0.45 seconds. The time from a previous peak at D, E, I, and J is 0.22 seconds. It can be determined the 0.22 second interval between beats is a false positive, because music (at least most contemporary music) is played between 60 and 180 beats per minute. The 0.22 second interval represents 272 beats per minute (BPM) which is too fast. In FIG. 2, tempo (in BPM) is calculated using the following equation:

$$\text{Tempo}=60\ \text{sec/min}\div\text{interval between beats (sec/beat)}=60/0.45=133\ \text{BPM} \qquad \text{Equation (1)}$$

Similarly the calculation for the false positive is:

$$\text{Tempo}=60/0.22=272\ \text{BPM}$$

Therefore, the 0.45 interval represents a more likely BPM result. This is within the range of 60 to 180. Therefore, pulses at D and I are determined to be false beats and it is deduced that 133 is the correct BPM value.

Figure 3:
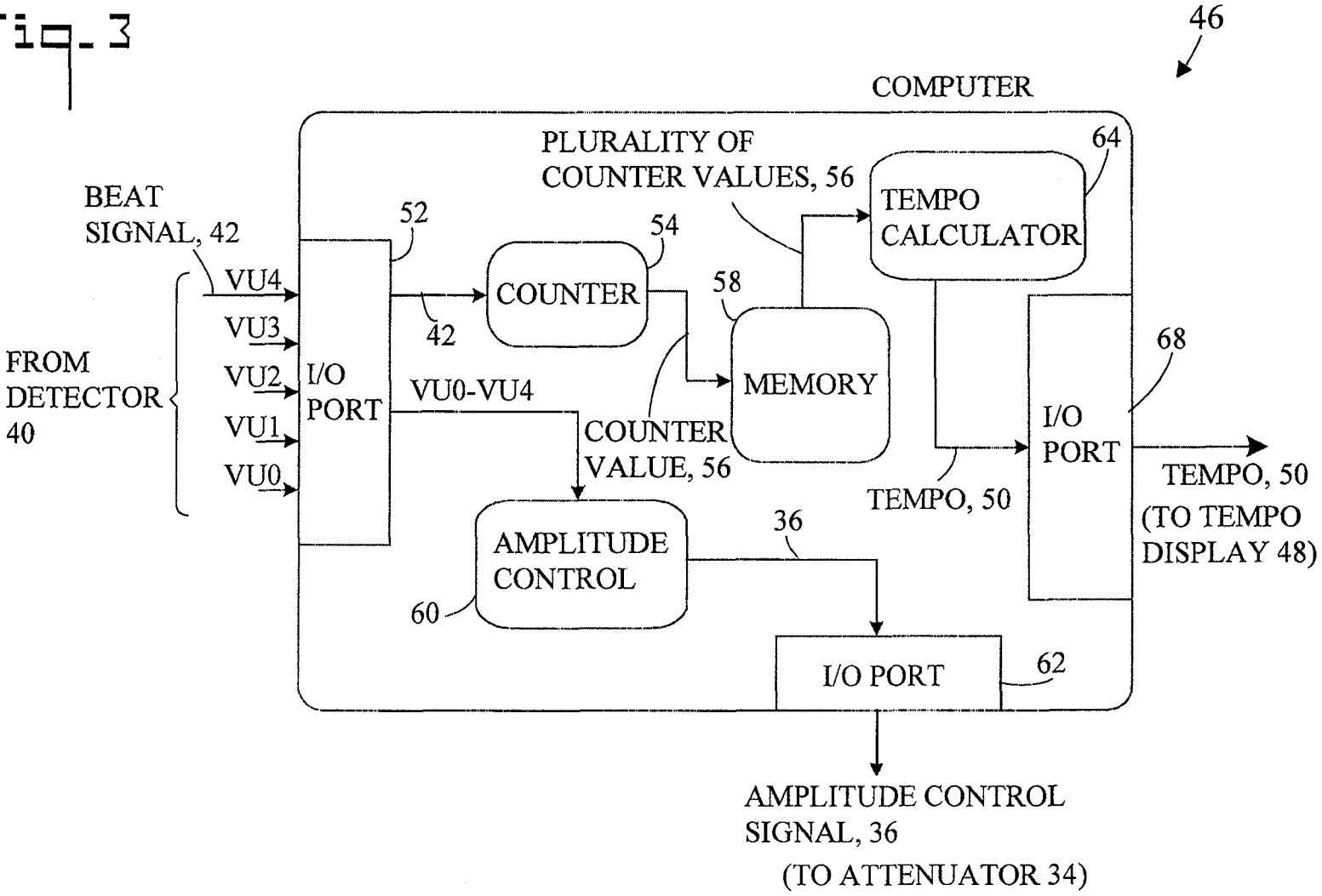
FIG. 3 is a block diagram of a computer.

Referring again to FIG. 1, system 20 further includes computer 46 which receives beat signal 42 from detector 40 and calculates the tempo 50 of the music (also refer to FIG. 3 and the associated discussion). As used herein the term "computer" means a programmable general purpose device which can implement a set of logic and arithmetic operations. The computer can be a microcontroller, a microprocessor, a PC or any other similar device. In a useful embodiment, computer 46 is a microchip 16F1938 microcontroller; however, other microcontrollers, microprocessors, etc. could also be used. In an embodiment, a tempo display 48 receives and displays (in BPM) the calculated tempo 50 from computer 46.

FIG. 3 is a block diagram of computer 46. Computer 46 contains firmware and software which provide control and calculations for system 20. As discussed above, the digital outputs of detector 40 (dot/bar display driver) are shown as VU0, VU1, VU2, VU3, and VU4: VU0-being the most sensitive output signal, and VU4 being the least sensitive output signal from detector 40. That is, VU4 will only become active when audio is at its loudest. VU0-VU4 are connected to digital 110 port 52 allowing computer 46 to read their states at any time. In addition, the digital input associated with the least sensitive output signal (VU4) responds as an edge-triggered interrupt signified as beat signal 42. Whenever VU4 (the least sensitive output signal) transitions from a logic low to a logic high, it defines beat signal 42 which activates a counter 54. Counter 54 starts counting each time beat signal 42 is received, and stops counting when a next beat signal 42 is received. When counter 54 stops counting, it has a counter value 56. That is, at the moment VU4 transitions from a logic low to a logic high a signal is sent to counter 54. Counter 54 is set to count from 0 to 60 in one second. It divides one second into 60 parts providing resolution of 1/60th second. Each time beat signal 42 is received, a counter value 56 is sent to memory 58. Memory 58 receives and stores a plurality of counter values 56. For example, if a drum is struck two times a second, memory 58 will contain a plurality of counter values 56 of 30 which indicates each drum beat is 30/60 seconds apart or 120 BPM.

Computer 46 further includes an amplitude control 60 which sends amplitude control signal 36 to attenuator 34 (also refer to FIG. 1). Amplitude control 60 is a software module which monitors digital I/O port 52 and controls attenuator 34 to create the optimum frequency of beat signals 42 (interrupts from VU 4). Amplitude control signal 36 is sent from amplitude control 60 to attenuator 34 via I/O port 62. Amplitude control signal 36 automatically adjusts the resistance of attenuator 34 up or down as was discussed above. In one embodiment the resistance is changed incrementally one step at a time. For example if the resistance of attenuator 34 is too low (signal too high), amplitude control signal 36 causes the resistance to increase by 100 ohms. At the next cycle, if the resistance is still too low, resistance is increased by another 100 ohms, etc.

System 20 is designed to sense tempo 50 in the range of 60 to 180 BPM. That translates to a minimum of one (60 BPM)

to three (180 BPM) beat signals 42 per second. This means, if there is less than one beat signal 42 in a one second period, the sensitivity of system 20 needs to increase. Likewise, if there are more than three beat signals 42 in a one second period, the sensitivity needs to decrease. That is, amplitude control signal 36 increases attenuation of amplified electrical signal 28 when a number of beat signals 42 exceeds three in one second, and amplitude control signal 36 decreases attenuation of amplified electrical signal 28 when a number of beat signals 42 is less than one in one second (refer also to FIG. 1). In general, sensitivity is adjusted incrementally (one step at a time) for the purpose of fine tuning, however sensitivity can also be changed in large steps (multiple step at a time). To that end, in FIG. 3 it is noted that all five VU outputs VU0-VU4 are detected by amplitude control 60. This aids in a faster response to sudden changes in music volume. For example, if there are no beat signals 42 being detected and it is seen that VU0 and VUI are the only outputs that change, then sensitivity can be increased in multiple steps (as opposed to one step at a time as discussed above) in order to activate VU4. As such, amplitude control signal 36 would lower the resistance of attenuator 34 by multiple steps (e.g. 300 ohms at a time) in order to more quickly cause VU4 to provide a beat signal 42 (also refer to FIG. 1). That is, amplitude control signal 36 can change the attenuation of amplified electrical signal 28 in one of (1) single steps, and (2) multiple steps. In another example, if only the most sensitive output signal (VU0) is present, amplitude control signal 36 changes the attenuation of the amplified electrical signal 28 in multiple steps. As described above, the same multiple step change could be made if only the two most sensitive output signals VU0 and VU1 are present. It should also be noted at this time, the embodiments of the present invention will also work equally well if using VU3 to detect beat events instead of VU4.

Computer 46 further includes a tempo calculator 64 which uses plurality of counter values 56 to calculate the tempo 50 of the music. Tempo calculator 64 is a software module which scans memory 58 for the most common counter value 56 which equates to the most common interval between beats signals 42. Referring back to FIG. 2, the interval between beats A and B is 0.45 seconds and corresponds to a counter value 56 of:

counter value (counts)=60 counts/sec×interval between beats (sec) Equation (2)

counter value=60 counts/sec×0.45 sec=27 counts

That is, 27 counts corresponds to an interval between beats of 0.45 sec. However the interval between beats I and J is 0.22 seconds. Therefore, the associated counter value 56 is:

counter value=60 counts/sec×0.22 sec=13

In the case of FIG. 2, memory 58 will contain the following values: 27, 27, 13, 13, 27, 27, 27, 13, 13 in that order. Tempo calculator 64 will then examine memory content and determine that a counter value 56 of 27 represents the most likely tempo 50 as follows:

From Equation (1)

Tempo (BPM)=60 sec/min÷interval between beats (sec)

From Equation (2)

counter value (counts)=60 counts/sec×interval between beats (sec), or rewriting interval between beats (sec)=counter value·(counts)÷60 counts/sec Equation (3)

Plugging Equation (3) into Equation (1)

Tempo=60 sec/min÷counter value (counts)÷60 counts/sec, or rearranging

Tempo=[60 sec/min×60 counts/sec]÷counter value (counts), or simplifying,

Tempo=3600 counts/min÷counter value (counts) Equation (4)

For the example of FIG. 2, the tempo calculation is:

Tempo=3600÷27=133 BPM

After tempo calculator 64 calculates tempo 50, the tempo value 50 is routed to I/O port 68 and thence to tempo display 48 (refer to FIG. 1).

Counter values 56 can be filtered based on some simple rules of music as follows:

a) Music will not be played slower than 60 BPM; therefore, a counter value 56 greater than 60 (interval between beats greater than one second) is not valid and should not be used in BPM calculations.

b) Music will not be played faster than 180 BPM; therefore, a counter value 56 less than 0.33 seconds (interval between beats less than 0.33 seconds) is not valid and should not be used in BPM calculations.

Putting a) and b) another way, tempo calculator 64 disregards counter values 56 which would result in a tempo 50 of less than about 60 beats per minute (BPM) or greater than about 180 beats per minute (BPM) in the calculation of tempo 50.

c) Music will typically not make sudden changes in tempo 50. Therefore, large changes in BPM can be filtered out.

However, to account for a drifting tempo 50 during a live performance, memory 58 is a circular buffer in which the oldest data is over written with the newest. As tempo 50 drifts, so will the most common counter value 56.

Figure 4:
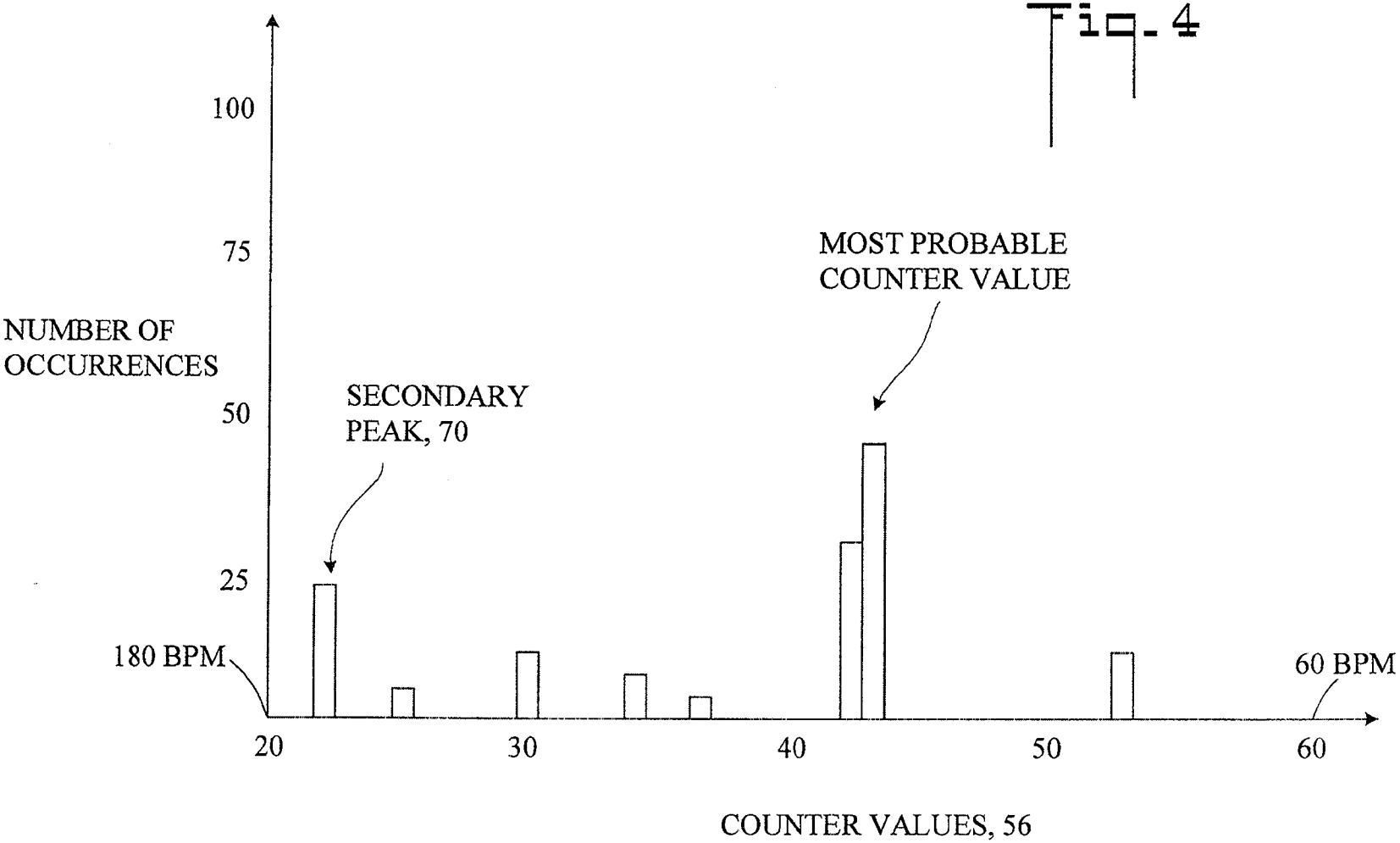
FIG. 4 shows an example accumulation of count values in a memory.

FIG. 4 shows an example accumulation of counter values 56 in memory 58. Referring also to FIG. 3, beat signals 42 generated by detector 40 correlate to counter values 56 between 20 (180 BPM) and 60 (60 BPM) represented on the horizontal axis. The number of counter values 56 recorded for each beat signal 42 is represented on the vertical axis. Counter values 56 are usually scattered across the entire spectrum between 20 and 60, rather than being neatly clustered at a single value. If memory 58 holds 100 counter value samples, then FIG. 4 might represent the distribution as shown. In this example, the most common (frequent) counter value 56 is 43. From Equation 4, this corresponds to:

Tempo=3600÷43=83 BPM

However, it is noted that their also exists a significant peak for a counter value 56 of 42. This indicates the actual tempo is slightly faster than 83 BPM. One can average the two peaks to create a more accurate most probable counter value 56 of 42.5. The tempo calculation then becomes:

Tempo=3600÷42.5=84 BPM

Putting this process another way, tempo calculator 64 analyzes a plurality of counter values 56 and selects a most probable counter value which is used to calculate tempo 50.

Typically, there exists a secondary peak 70 which occurs when looking at a music sample. This is because music can have notes/percussion that occur on ⅛ notes (as well as ¼ notes). In music theory, a ¼ note typically represents a note played for the duration of 1 beat and, thus, an ⅛ note would be played twice per beat. This means there is usually a secondary peak 70 at half the primary peak. In this example, the secondary peak 70 occurs at a counter value 56 of approximately 22. This secondary peak 70, along with the remaining counter values 56 which are scattered across the spectrum can be ignored in the determination of the most probable counter value 56.

It is noted that the foregoing discussion of tempo calculation is exemplary in nature. Adjustments can be made by one skilled in the art. For example, counter 54 can be set to count from 0 to 120 every second (instead of 0 to 60) in order to increase resolution.

As such, a more general version of the equation for calculating tempo 50 becomes:

$$\text{Tempo}=60\times C\ (\text{counts/min})\div\text{counter value (counts)} \qquad \text{Equation (5)}$$

where C=the number of counter 54 counts per second

That is, tempo 50 in beats per minute (BPM)=(60/most probable counter value)×C, where C is the number of counts provided by counter 54 per second.

Figure 5:
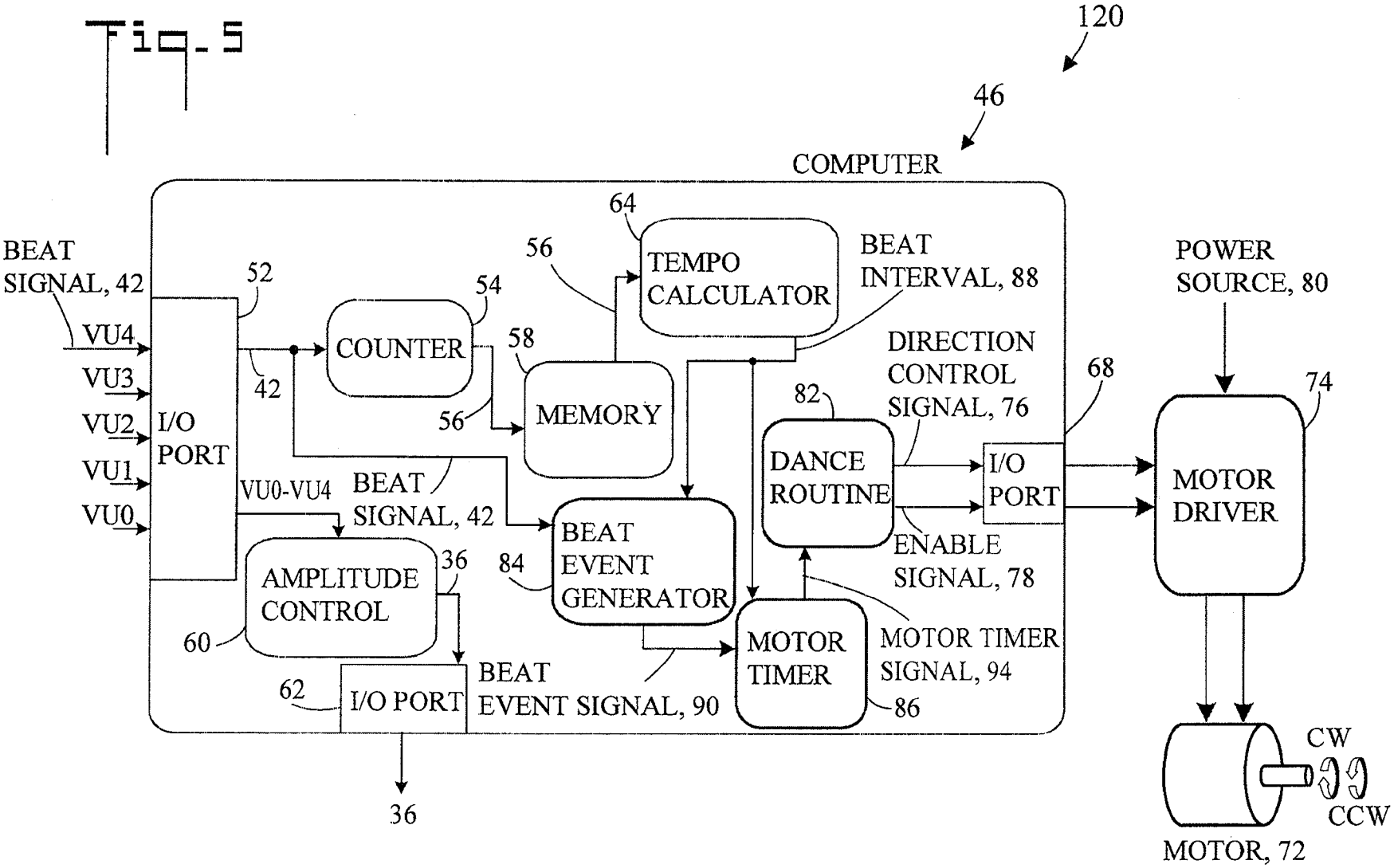
FIG. 5 is a block diagram of a second embodiment of the system which is used to synchronize the motion of a motor with the tempo of the music; and, FIG. 6 is a timing diagram which shows the time relationship between various signals of the system.
Figure 5:
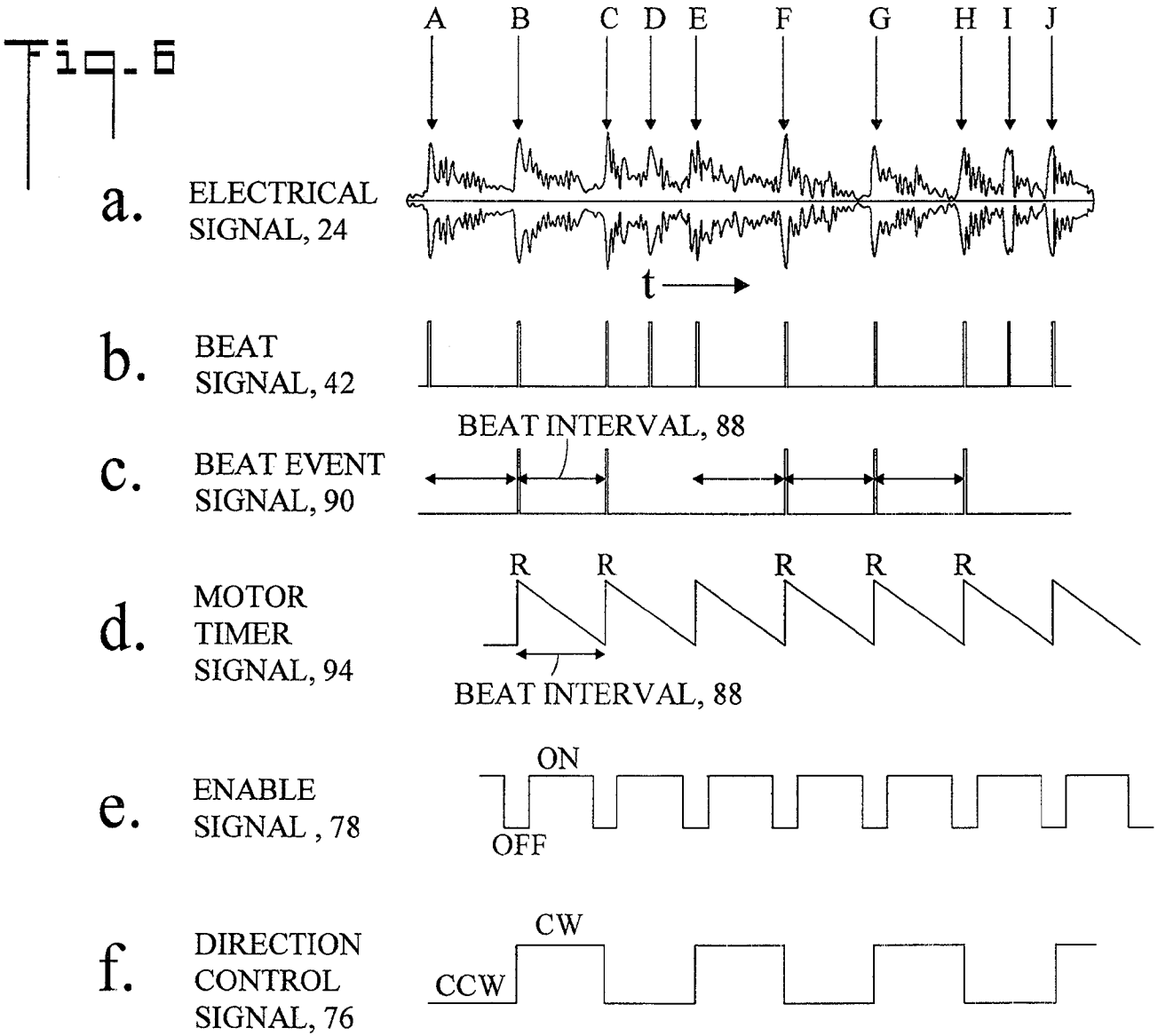

FIG. 5 is a block diagram of a second embodiment of the system generally designated as 120 which is used to synchronize the motion of a motor with the tempo of the music. Embodiment 120 is similar to the tempo calculation embodiment of FIG. 3 but without tempo display 48 and with the addition of an external DC motor 72, a motor driver 74, and certain additions to computer 46 discussed below. Motor 72 has clockwise CW direction of rotation and an opposite counterclockwise CCW direction of rotation. Motor driver 74 is an electrical module for controlling activation and direction of motor 72. A TB6612 is an example of such a DC motor controller. The turning direction of motor 72 is dictated by a direction control signal 76 from computer 46. Direction control signal 76 is sent from computer 46 to motor driver 74, and controls the direction of rotation of motor 72, and has a clockwise state and a counterclockwise state. The activation of motor 72 is controlled by an enable signal 78 from computer 46. Enable signal 78 is sent from computer 46 to motor driver 76, and turns motor 72 on or off. In the shown embodiment, since DC motors require a substantial power source compared to all other electronics in the system, a separate DC power source 80 is provided.

Almost all animated toys are driven by DC motors that spin in one direction. Through a series of gears and actuators, rotational motion of the DC motor is translated into back and forth motion of various aspects of the toy. For example, a doll's head might move back and forth, the hips might move accordingly, a foot, etc. It then becomes possible to turn motor 72 in the clockwise (CW) direction, pause, turn motor 72 in the counterclockwise (CCW) direction, pause, turn motor 72 in the CW direction, etc. to create a "dancing" motion. If the pause is synchronized with a predicted next beat, the illusion is created the toy is "dancing" in time to music.

In the shown embodiment, all components of computer 46 are the same as those shown in FIG. 3, except for the addition of a dance routine 82, a beat event generator 84, and a motor timer 86. Dance routine 82 is a software module which correlates mechanical dance moves to beat. Motor timer 86 is used to count to a pending change in movement. Motor timer 86 is set to repeatedly count down from a beat interval 88 which is provided by tempo calculator 64. Beat interval 88 is the time between beats as calculated by tempo calculator 64 and is directly related to most probable counter value 56. For example, in the discussion of FIG. 4 above, the most probable counter value was 42.5. This most probable counter value corresponds with a beat interval 88 of:

$$\text{beat interval}=42.5\ \text{counts}/60\ \text{counts/sec}=0.71\ \text{seconds}$$

Motor timer 86 counts down from the calculated beat interval 88, automatically resets, counts down again, resets, etc. That is, motor timer 86 uses beat interval 88 to repeatedly count to an upcoming change in direction of rotation of motor 72. The cyclic action of motor timer 86 forms the heartbeat of embodiment 120, and as will be discussed below, controls the generation of direction control signal 76 and enable signal 78 by dance routine 82.

FIG. 6 is a timing diagram which shows the time relationship between various signals of embodiment 120 (also refer to FIG. 5). As was shown in FIG. 2 and described above, peaks A-J in electrical signal 24 result in beat signal 42 (refer to FIG. 6 signals a. and b, respectively). A beat event signal 90 (shown in FIG. 6 at c.) is created from beat signal 42 and beat interval 88. Whenever a time between two successive beat signals 42 is equal to beat interval 88, motor timer 86 is reset. In the shown example, beat event signals 90 are generated at B, C, F, G, and H. No beat event signal 90 is generated at A because there was no preceding beat signal 42. No beat event signal 90 was generated at D (false beat), because the time from C to D was not equal to beat interval 88. Similarly, no beat event signal 90 was generated at E, because the time from D to E was not equal to beat interval 88. Similarly, no beat event signal 90 was generated at I and J. In the shown embodiment, beat event signal 90 is generated by a beat event generator 84 using beat signal 42 from detector 40 (refer to FIG. 3.) and beat interval 88 from tempo calculator 64 (refer to FIG. 5).

Motor timer 86 generates a motor time signal 94 (shown in FIG. 6 at d.) which repeatedly count down from a beat interval 88 which is provided by tempo calculator 64. When the count down is completed, motor timer signal 94 is reset and a new count begins. This is shown by the saw tooth shape of motor timer signal 94. This counting process proceeds independently of any signals other than beat interval 88. By knowing the interval between beats and knowing the exact moment a beat occurs, software can predict when the next upcoming beat will occur. Dance routine 82 can then engage motor 72 to produce motion in an animated character. However, over time, it is expected that motion and beat will drift. To assure that motion and beat remain synchronized, beat event signal 90 is used to reset timer motor 86 (see discussion below).

Enable signal 78 (shown in FIG. 6 at e.) and direction control signal 76 (shown in FIG. 6 at f) are generated by dance routine 82 based upon motor timer signal 94. Motor timer 94 (through motor timer signal 94) causes enable signal 78 to turn off before beat interval 88 ends, and to turn back on after beat interval 88 ends. That is enable signal 78 is off for a period around the reset of motor timer signal 94, and is on for other times. Motor timer 86 also causes direction control signal 76 to change state from high (CW to low (CCW) each time enable signal 78 is off. As such, it can be seen that motor 72 is stopped just prior to beat onset and resumes shortly after. This pausing (enable off) and direction reversal (CW and CCW) pattern creates animated moves which are synchronized with the beat of the music. Thus in the example of FIG. 6, motor 72 moves in the CCW direction shortly after A, pauses just before B, moves in the CW direction shortly after B, pauses just before C, moves in the CCW direction shortly after C, etc. Dance routine 82 makes changes to direction control 76 and enable 78 in order to create motor movement between beats and a pause on the beat. This timing is coordinated by motor timer signal 94 of motor timer 86. Also, different motor movement can be created by changing the relationship between direction control signal 76 and enable signal 78. A duty cycle applied to enable signal 78 allows motor 74 to turn at different speeds, etc.

Again referring to FIG. 6, it is possible that beat signal 42 and motor timer signal 94 can get out of synchronization. For example, this can be due to drift in the actual beat of the music, or because of rounding errors introduced by computer 46. When this happens, beat event signal 90 resets motor timer signal 94 as indicated by the "R" to get the beat and motor timer signal 94 back in synchronization. That is, resetting of motor timer 86 ensures that motor timer signal 94 is synchronized with the music. It is assumed that if the time from the previous beat signal 42 matches the calculation for beat interval 88, the beat signal 42 must have occurred on beat. Therefore, the current beat signal 42 (as a beat event signal 90) can be used as a reference point for aligning motion. The reset causes motor timer signal 94 to start counting down from beat interval 88. As such, the starting point of motor timer signal 94 is continuously re-aligned in time to stay on beat.

Some of the salient features of system 20 are:

Data is extracted from ambient sounds (e.g. live rock band). Input can be any music source played through speakers and audible to the human ear. Beat analysis is acoustically coupled to sound source via a microphone.

The entire sound spectrum is input to the microphone.

There is no analog sampling done by the computer. Timing is triggered by a digital output from the detector.

Software analysis is done on time between events caused by output from the detector. Data occurs as a continuous stream.

Data is filtered based on typical music principles. i.e. data should fall within the range of 60 to 180 BPM. Data outside this range is ignored.

The threshold of amplitude peaks is set electrically.

BPM is analyzed to predict the next occurring beat. This prediction is then used to engage a DC motor so that motion happens between beats and momentarily stops at the exact same time of the next occurring beat.

The software algorithm is quite easy to implement.

Dance synchronization to beat is created by pausing on beat.

Synchronization is based on anticipation of next beat in order to stop movement.

The embodiments of the system described herein are exemplary and numerous modifications, combinations, variations, and rearrangements can be readily envisioned to achieve an equivalent result, all of which are intended to be embraced within the scope of the appended claims. Further, nothing in the above-provided discussions of the system should be construed as limiting the invention to a particular embodiment or combination of embodiments. The scope of the invention is defined by the appended claims.

I claim:

1. System for calculating the tempo of music, comprising:

an amplitude adjuster for receiving an electrical signal of the music and outputting an amplitude-adjusted electrical signal;

a detector for receiving said amplitude-adjusted electrical signal and outputting a beat signal when an amplitude of said amplitude-adjusted electrical signal exceeds a threshold value; and a computer for receiving said beat signal and calculating the tempo of the music; and wherein:

said amplitude adjuster including an amplifier for receiving said electrical signal and outputting an amplified electrical signal, and an attenuator for receiving and selectively attenuating said amplified electrical signal and outputting said amplitude-adjusted electrical signal; and said computer including an amplitude control for sending an amplitude control signal to said attenuator, said amplitude control signal changing attenuation of said amplified electrical signal in one of (1) single steps, and (2) multiple steps.

2. The system according to claim 1, further comprising:

a tempo display for receiving and displaying the calculated tempo from said computer.

3. The system according to claim 1, wherein:

said amplitude adjuster including an amplifier for receiving said electrical signal and outputting an amplified electrical signal, and an attenuator for receiving and selectively attenuating said amplified electrical signal, and outputting said amplitude-adjusted electrical signal.

4. The system according to claim 3, wherein:

said attenuator being a digitally controlled potentiometer.

5. The system according to claim 1, wherein:

said detector being a dot/bar display driver.

6. The system according to claim 1, wherein:

said computer including a counter for starting to count each time said beat signal is received, and stopping to count when a next beat signal is received, said counter having a counter value when said counter stops counting; and said computer also including a memory for receiving and storing a plurality of counter values.

7. The system according to claim 6, wherein:

said computer including a tempo calculator for calculating the tempo of the music based on said PLURALITY of said counter values.

8. The system according to claim 7, wherein:

said tempo calculator disregarding counter values which would result in the tempo of less than about 60 beats per minute or greater than about 180 beats per minute in said calculation of the tempo.

9. The system according to claim 7, wherein:

said tempo calculator analyzing said plurality of said counter values and selecting a most probable counter value for calculating the tempo.

10. The system according to claim 9, wherein:

the tempo calculated according to the following equation:

tempo in beats per minute=(60/most probable counter value)×C, where C is the number of counts provided by said counter per second.

11. The system according to claim 1, wherein:

said amplitude control signal increases attenuation of said amplified electrical signal when a number of beat signals exceeds three in one second, and said amplitude control signal decreases attenuation of said amplified electrical signal when a number of said beat signals is less than one in one second.

12. The system according to claim 1, further comprising:

a motor having clockwise direction of rotation and an opposite counterclockwise direction of rotation;

a motor driver which controls said motor;

a direction control signal which is sent from said computer to said motor driver, said direction control signal controlling said direction of rotation of said motor, said direction control signal having a clockwise state and a counterclockwise state; and an enable signal which is sent from said computer to said motor driver, said enable signal turning said motor on or off.

13. The system according to claim 12, wherein:

said computer including a tempo calculator which outputs a beat interval; and said computer including a motor timer which uses said beat interval to repeatedly count to an upcoming change in said direction of rotation of said motor.

14. The system according to claim 13, wherein:

said motor timer being reset when a time between two successive said beat signals is equal to said beat interval.

15. The system according to claim 14, further comprising:

a beat event generator for generating a beat event signal whenever the time between two successive said beat signals equals said beat interval.

16. The system according to claim 14, wherein:

said motor timer is reset for ensuring that said motor timer is synchronized with the music.

17. The system according to claim 13, wherein:

said motor timer causing said enable signal to turn off before said beat interval ends, and to turn back on after said beat interval ends.

18. The system according to claim 17, wherein:

said direction control signal changing state each time said enable signal is off.

* * * * *